US005873331A

United States Patent [19]

Jutz

[11] Patent Number: 5,873,331

[45] Date of Patent: Feb. 23, 1999

[54] CYLINDER HEAD FOR A MULTI-CYLINDER INTERNAL COMBUSTION ENGINE

[75] Inventor: Bernhard Jutz, Burgstetten, Germany

[73] Assignee: Daimler-Benz A.G., Stuttgart, Germany

[21] Appl. No.: 49,435

[22] Filed: Mar. 27, 1998

[30] Foreign Application Priority Data

Mar. 29, 1997 [DE] Germany ..... 197 246.4

[51] Int. Cl.[6] ..... F02F 1/36

[52] U.S. Cl. ..... 123/41.82 R; 123/193.5

[58] Field of Search ..... 123/41.82 R, 193.5

[56] References Cited

U.S. PATENT DOCUMENTS 4,530,323 7/1985 Wakasa ..... 123/41.82 R

FOREIGN PATENT DOCUMENTS 3513126 2/1987 Germany .

*Primary Examiner*—Noah P. Kamen
*Attorney, Agent, or Firm*—Klaus J. Bach

[57] ABSTRACT

In a cylinder head of a multicylinder internal combustion engine comprising a casting having a bottom wall, a top wall and outer side walls delimiting together a cooling water space through which intake and exhaust passages extend to the side walls, cylinder head bolt-receiving tubular columns extend from the top walls toward the bottom walls only to a certain distance from the bottom wall and are joined to the side walls and transverse walls for uniformly transmitting bolting forces from the bolt receiving tubular columns to the bottom wall.

11 Claims, 5 Drawing Sheets

CYLINDER HEAD FOR A MULTI-CYLINDER INTERNAL COMBUSTION ENGINE

BACKGROUND OF THE INVENTION

The invention relates to a cylinder head for a multi-cylinder internal combustion engine with a cooling water space delimited by side walls and bottom and top walls. Intake and exhaust passages extend through the water space to opposite side walls and cylinder head bolt-receiving tubular columns through which the cylinder head bolts pass and which are inter-connected by reinforcement walls extending to the bottom wall of the cooling water space.

DE-A 35 13 126 discloses such a cylinder head which includes reinforcement walls between the cylinder head bottom wall and the cylinder head top wall which are also connected to the columns receiving the cylinder head mounting bolts. In this arrangement however a large part of the clamping forces is transmitted to the engine block on which the cylinderhead is bolted directly by the cylinder-head bolt-receiving columns.

It is the object of the present invention to provide such a cylinder head in such a way that the bolt forces are evenly distributed over the cylinder head on which the cylinder head is mounted particularly over the circumference of each combustion chamber.

SUMMARY OF THE INVENTION

In a cylinder head of a multi-cylinder internal combustion engine comprising a casting having a bottom wall, a top wall and outer side walls delimit together a cooling water space through which intake and exhaust passages extend to the side walls. Cylinder head bolt-receiving tubular columns extend from the top walls toward the bottom walls only to a certain distance from the bottom wall and are joined to the side walls and transverse walls for uniformly transmitting bolting forces from the bolt receiving tubular columns to the bottom wall.

With the arrangement according to the invention, wherein the bolt receiving columns do not extend fully down to the cylinder head bottom wall, the bolt forces are uniformly transmitted to the cylinder head and transverse walls surrounding each combustion chamber. As a result, the cylinder head is engaged with the engine block in an optimal manner over the circumference of each combustion chamber.

Preferably, the longitudinal walls and also the outer transverse walls are offset outwardly from the longitudinal center axis of the bolt columns. In this way, a still better distribution of the bolt forces over a larger area of the cylinder head bottom wall is achieved.

In order to improve the force transfer, the longitudinal and transverse walls can be supported on the end faces of the mounting bolt columns.

The side edges of the inner transverse walls may extend from the end faces of the respective bolt columns at an angle inwardly to the cylinder bottom wall in order to improve the engagement of the cylinder head bottom wall between the combustion chambers.

The length of the head bolt mounting columns is preferably about ⅔ of the distance between the bottom wall and the top wall of the cylinder head.

In order to prevent a moment from being applied to the longitudinal walls because of their eccentric connection to the head bolt mounting columns, support structures may be provided at the outside of the bolt mounting columns. The support structures extend from the lower ends of the bolt mounting columns down to the cylinder head bottom wall. Spaces may be provided between these supports and the adjacent longitudinal walls for the passage of cooling water.

An embodiment of the invention will be described below on the basis of the accompanying drawings.

DESCRIPTION OF A PREFERRED EMBODIMENT

Figure 1:
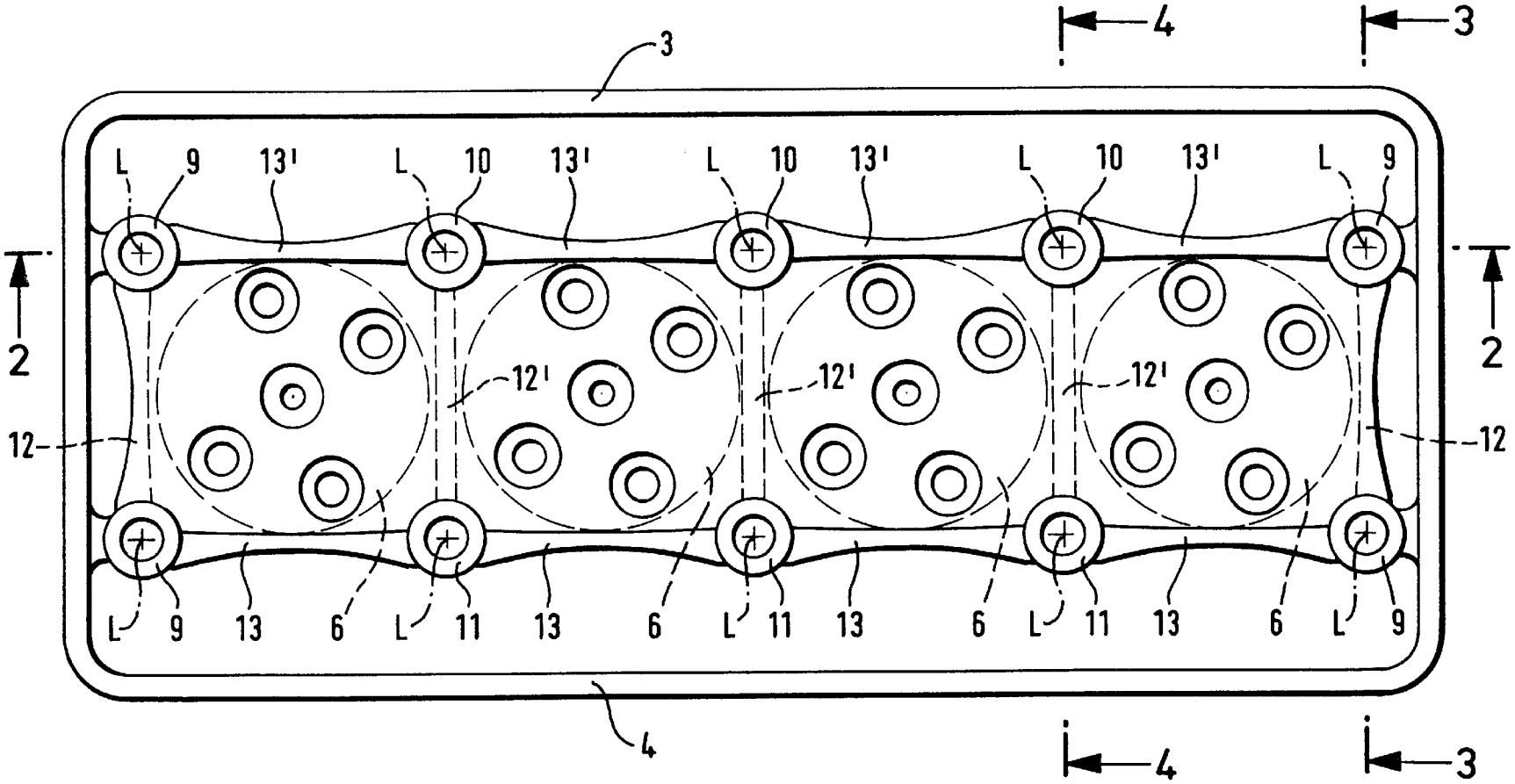
FIG. 1 is a top view of a cylinder head.
Figure 2:
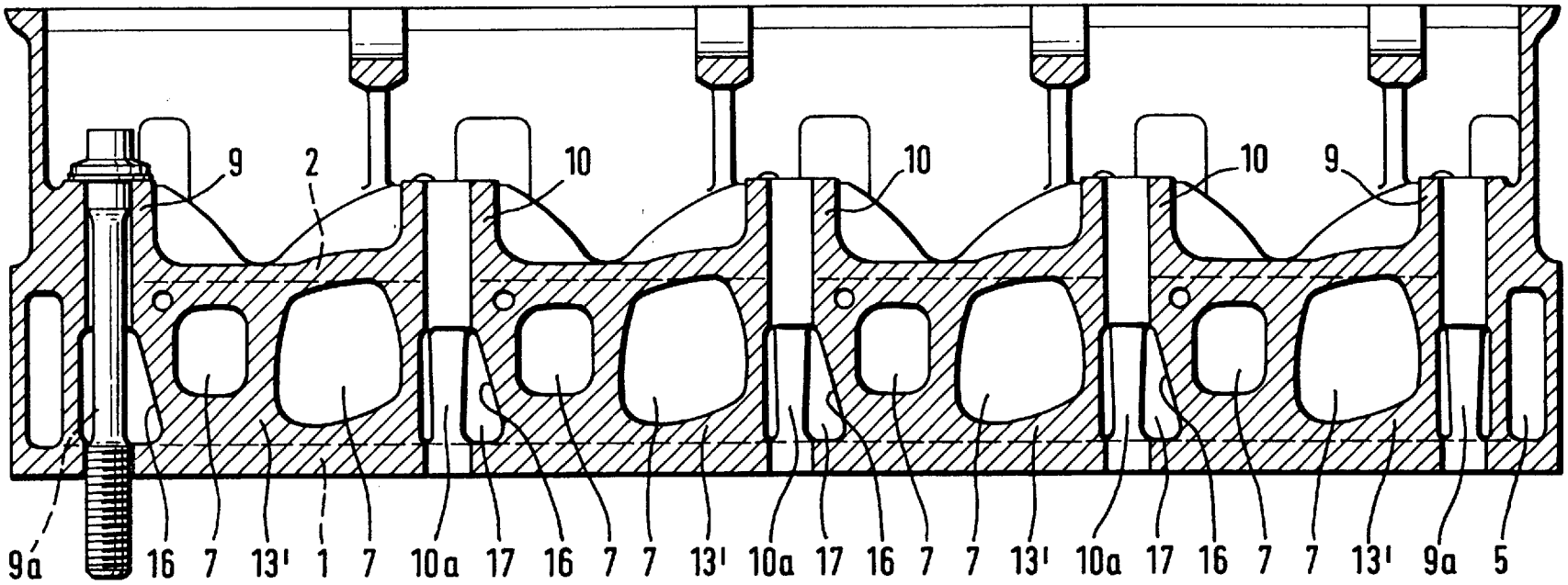
FIG. 2 is a cross-sectional view taken along line 2—2 of FIG. 1.
Figure 3:
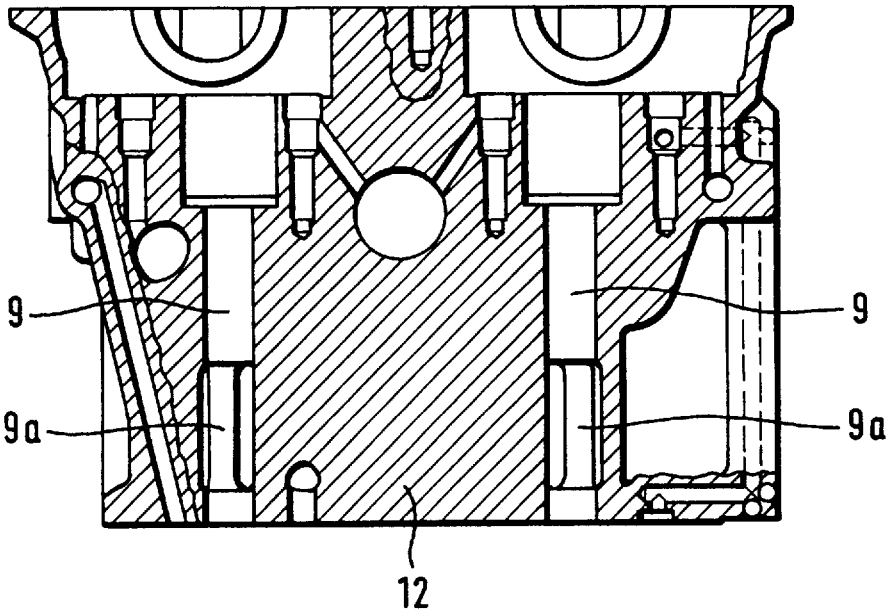
FIG. 3 is a cross-sectional view taken along line 3—3 of FIG. 1.
Figure 4:
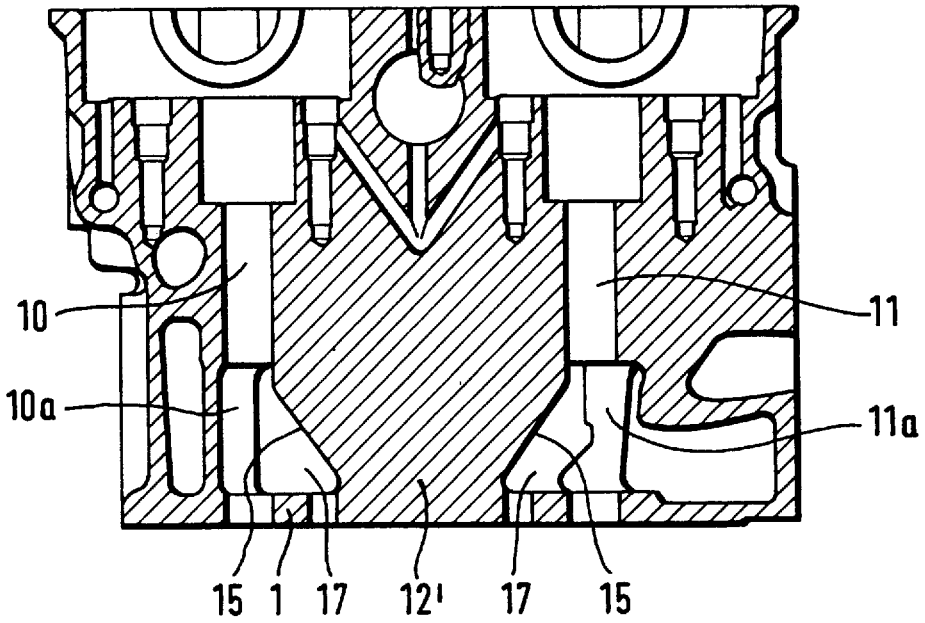
FIG. 4 is a cross-sectional view taken along line 4—4 of FIG. 1.

The cylinder head shown in FIGS. 1 to 4 is a cylinder head of a four cylinder internal combustion engine. It consists of a casting with a bottom wall 1, a top wall 2, side walls 3 and 4 and front and rear end walls 12, which together delimit a cooling water space 5. The underside of the bottom wall 1 defines for each cylinder the top surface of a combustion chamber 6 to which two exhaust gas passages 8 extend through the cooling water space 5 from, or respectively to, the side walls 3 and 4. For receiving the cylinder head bolts 9*a*, one of which is shown at the left end of FIG. 2, bolt mounting columns are cast onto the top wall 2. The outermost mounting columns are indicated by the numeral 9, the inner mounting columns at the inlet side of the cylinder head are indicated by the numeral 10 and the inner mounting columns at the exhaust side of the cylinder head are indicated by the numeral 11. As can be seen, each combustion chamber 6 is surrounded by four cylinder head bolt mounting columns. At the circumference of the combustion chamber 6, transverse walls extend transversely between opposite cylinder head bolt mounting columns. The outer transverse walls extending between the bolt mounting columns 9 is designated by the numeral 12'. Also, longitudinal walls extend between the bolt mounting columns 9, 10 and 11, which are indicated by the numeral 13 at the exhaust side of cylinder head and by the numeral 13' at the intake side of the cylinder head. The longitudinal walls 13 and 13' and the outer transverse walls 12 are cast onto the bottom wall 1 and the top wall 2 of the cylinder head. The longitudinal and transverse walls enclose cooling water chambers 5'.

Figure 5:
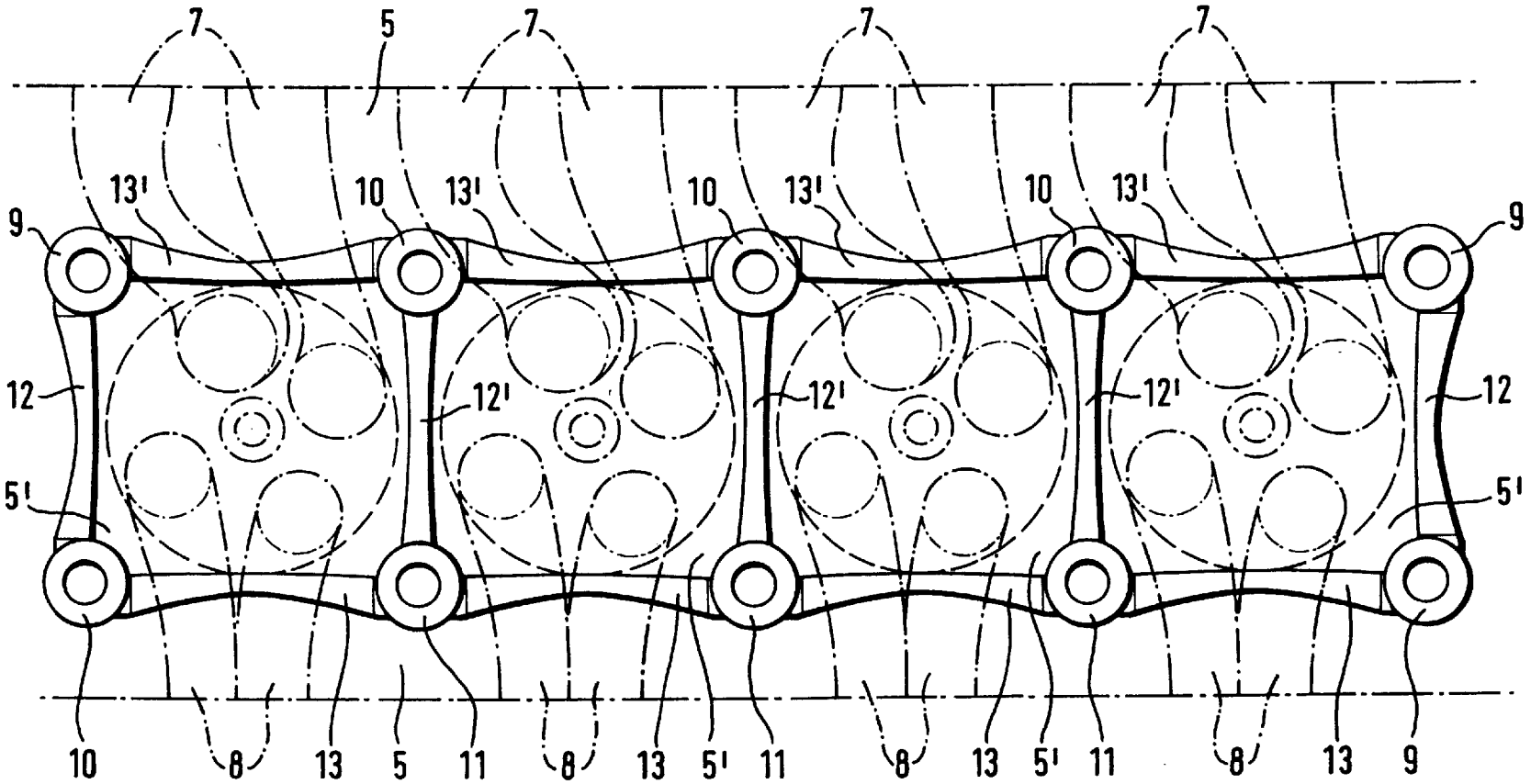
FIG. 5 is a top view of a structure of the cylinder head including longitudinal and transverse walls.
Figure 6:
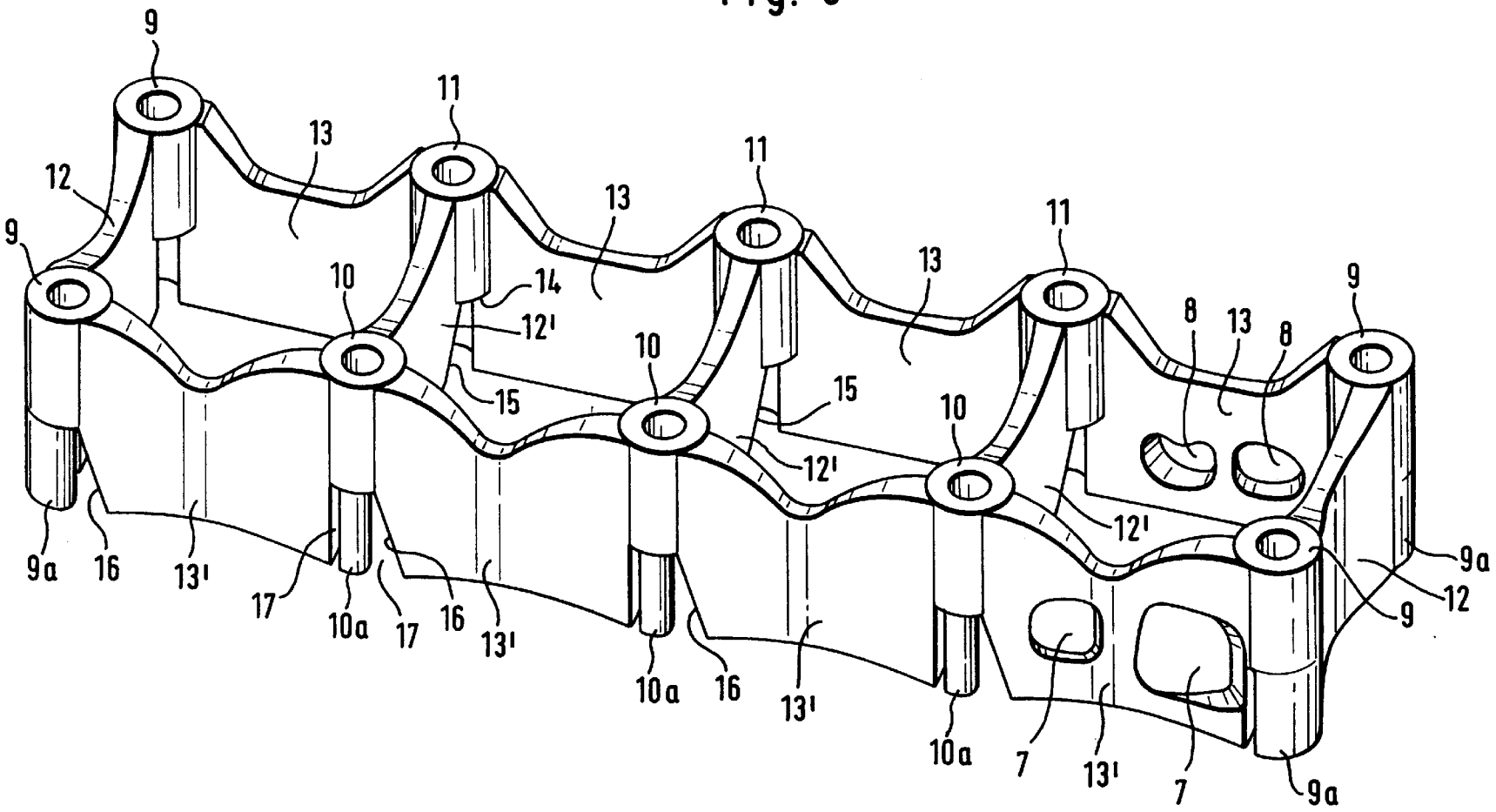
FIG. 6 is a perspective view of the structure shown in FIG. 5 as seen from the top and bottom sides thereof.
Figure 7:
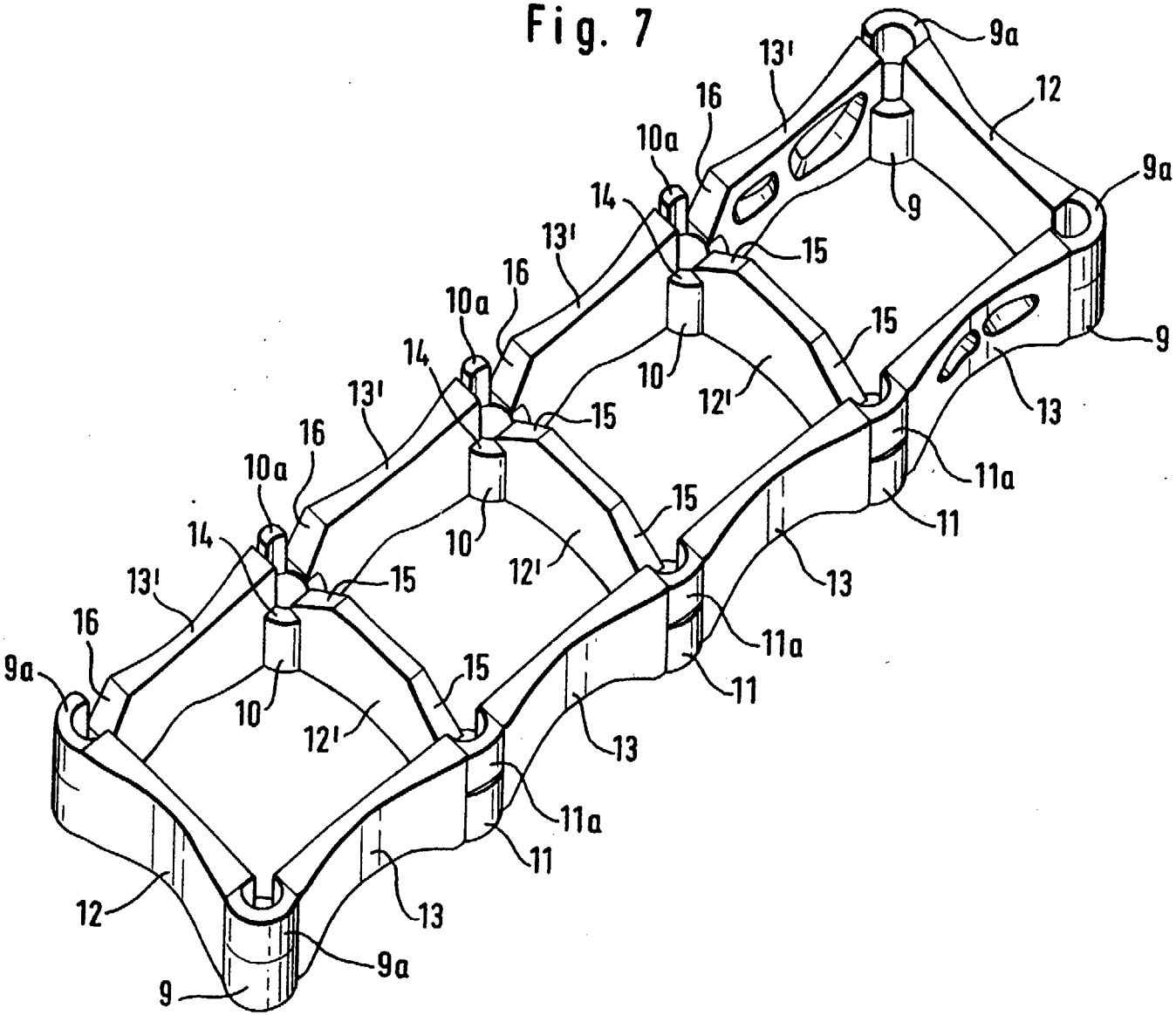

The structure formed by the transverse and longitudinal walls is shown alone in FIGS. 5, 6, and 7. For clarity reasons, the intake and exhaust passages, which extend through the longitudinal walls 13' and 13, and which are formed therewith have been omitted. In FIGS. 6 and 7, only the intake and exhaust passages 7 and 8 of the right end cylinder have been indicated.

In order to provide for an optimal distribution of the forces generated by the cylinder head bolts and consequently, for a uniform engagement of the cylinder head with the cylinder block, particularly along the circumference of each combustion chamber, the head bolt mounting columns 9, 10, and 11 extend with their full wall thickness from the top wall 2 downwardly only for about ⅔ of the height of the cooling water space, that is, the distance between the bottom wall 1 and the top wall 2. Over the rest of the way, they extend further down to the bottom wall 1 as support structures 9*a*, 10*a*, and 11*a* disposed along the outside of the side and end walls of the cylinder head. As apparent, particularly from FIGS. 6 and 7, the inner transverse walls 12' are connected only to the bolt mounting columns 10 and 11 and their side edges 15 extend from the ends 14 of the bolt mounting columns in an inclined fashion down to the bottom wall 1 of the cylinder head. As a result, the bolt forces are evenly distributed to the longitudinal and transverse walls so that the cylinder head is pressed onto the engine block along the circumference of each combustion chamber in an optimal manner, particularly between adjacent cylinders. With the inclined side edges furthermore, passages for the cooling water are provided.

At the exhaust side, the support structures 11*a* extend over about 180° of the circumference of the bolt mounting columns 11; however, at the intake side, the support structures 10*a* are so narrow that, between them and the two adjacent longitudinal walls 13', there remain gaps 17 (FIGS. 2, 6) for the passage of cooling water.

As can be seen especially from FIG. 5, the side walls 13 and 13' and the outer transverse walls 12 are offset outwardly from the longitudinal center axes plane of the bolt mounting columns. In this way, bending forces are counter-acted and a better distribution of the bolt forces over a larger area of the cylinder head is obtained. In the center areas, these walls 12, 13 and 13' are inwardly recessed in order to provide engagement forces as close as possible to the circumference of each combustion chamber 6 inspite of the offset arrangement of the bolt mounting columns. As shown particularly in FIG. 7, the longitudinal and transverse walls are supported on the end faces 14 of the bolt mounting columns whereby the bolting force transmission to these walls is optimized. The support structures 9*a*, 10*a*, and 11*a*, which are formed onto the end faces 14 of the bolt mounting columns 9, 10 and 11 prevent that bending moments are applied to the longitudinal walls. As shown, the shape of the transverse and longitudinal walls is similar to that of a beam having a constant bending resistance over its length.

What is claimed is:

1. A cylinder head of a multicylinder internal combustion engine comprising a casting having a bottom wall with a bottom side defining for each cylinder a combustion chamber, a top wall spaced from said bottom wall and outer side walls delimiting together a cooling water space, at least one intake passage extending between each combustion chamber and one of said side walls and an exhaust passage extending between each combustion chamber and the other of said side walls, cylinder head mounting bolt-receiving tubular columns extending from said top wall toward said bottom wall and longitudinal and transverse walls extending between said bolt-receiving tubular columns and being joined with said bottom wall, said bolt receiving columns terminating at least in the circumferential areas thereof adjacent the space defined by the longitudinal and transverse walls at a predetermined distance from said bottom wall.

2. A cylinder head according to claim 1, wherein said longitudinal walls are outwardly offset from a plane including the longitudinal center axes of said bolt support columns.

3. A cylinder head according to claim 1, wherein said cylinder head includes outer transverse walls at opposite longitudinal ends of said cylinder head and said outer transverse walls are outwardly offset from the longitudinal center axes of said bolt support columns.

4. A cylinder head according to claim 1, wherein said longitudinal and transverse walls are supported by the end faces of said bolt support columns.

5. A cylinder head according to claim 1, wherein said transverse walls disposed between adjacent combustion chambers have at their bottom edges inclined end areas extending from said bolt support columns to said bottom wall.

6. A cylinder head according to claim 1, wherein said bolt support columns have an axial length of about ⅔ of the distance between said top and bottom walls.

7. A cylinder head according to claim 1, wherein, at the outer sides, said bolt support columns have support structures extending downwardly to said bottom wall.

8. A cylinder head according to claim 7, wherein, at the exhaust side of said cylinder head, said support structures extend around about 180° of said bolt support columns.

9. A cylinder head according to claim 7, wherein, at the intake side of said cylinder head, gaps remain between said support structures of said bolt support columns and the adjacent longitudinal walls.

10. A cylinder head according to claim 9, wherein at least some of the side edges of said longitudinal walls have inclined end portions extending between the bolt mounting columns and the bottom wall.

11. A cylinder head according to claim 1, wherein said transverse and said longitudinal walls have centrally recessed top edges providing for a beam structure generating a uniform bolting force distribution to said bottom wall.

* * * * *

UNITED STATES PATENT AND TRADEMARK OFFICE

CERTIFICATE OF CORRECTION

PATENT : 5,873,331

DATED : February 23, 1999

INVENTOR(S) : Bernhard Jutz

It is certified that error appears in the above-identified patent and that said Letters Patent is hereby corrected as shown below:

The title page has been deleted to be replaced with the attached title page.

In the drawings add Sheet 6 of 6, consisting of Fig. 7, as shown on the attached page.

Column 2, line 18, change "FIG. 6 is a perspective view"' to read --FIGS. 6 and 7 are perspective views--.

Signed and Sealed this

Twenty-ninth Day of August, 2000

*Attest:*

Q. TODD DICKINSON

*Attesting Officer*

*Director of Patents and Trademarks*

US005873331A

United States Patent [19]

Jutz

[11] Patent Number: 5,873,331

[45] Date of Patent: Feb. 23, 1999

[54] CYLINDER HEAD FOR A MULTI-CYLINDER INTERNAL COMBUSTION ENGINE

[75] Inventor: Bernhard Jutz, Burgstetten, Germany

[73] Assignee: Daimler-Benz A.G., Stuttgart, Germany

[21] Appl. No.: 49,435

[22] Filed: Mar. 27, 1998

[30] Foreign Application Priority Data

Mar. 29, 1997 [DE] Germany ..... 197 246.4

[51] Int. Cl.[6] ..... F02F 1/36

[52] U.S. Cl. ..... 123/41.82 R; 123/193.5

[58] Field of Search ..... 123/41.82 R, 193.5

[56] References Cited

U.S. PATENT DOCUMENTS 4,530,323 7/1985 Wakasa ..... 123/41.82 R

FOREIGN PATENT DOCUMENTS 3513126 2/1987 Germany .

*Primary Examiner*—Noah P. Kamen
*Attorney, Agent, or Firm*—Klaus J. Bach

[57] ABSTRACT

In a cylinder head of a multicylinder internal combustion engine comprising a casting having a bottom wall, a top wall and outer side walls delimiting together a cooling water space through which intake and exhaust passages extend to the side walls, cylinder head bolt-receiving tubular columns extend from the top walls toward the bottom walls only to a certain distance from the bottom wall and are joined to the side walls and transverse walls for uniformly transmitting bolting forces from the bolt receiving tubular columns to the bottom wall.

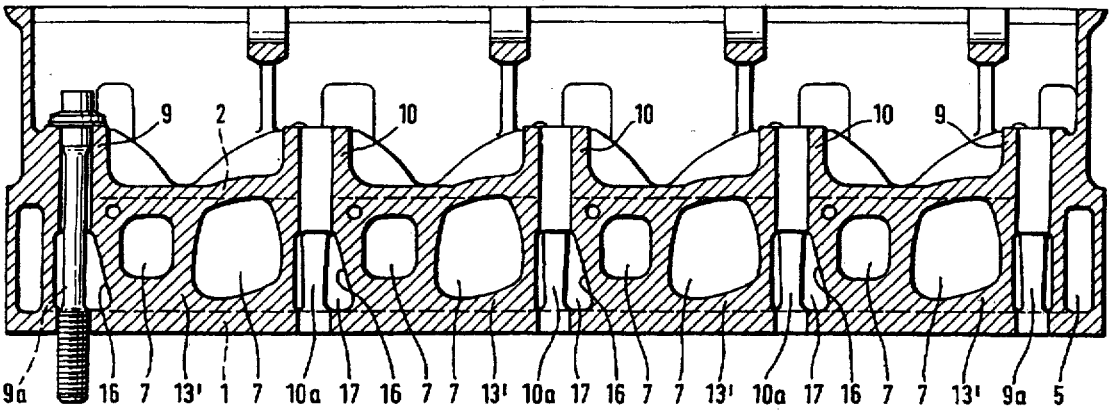

11 Claims, 6 Drawing Sheets